US005666849A

United States Patent [19]

Nakazawa et al.

[11] Patent Number: 5,666,849

[45] Date of Patent: Sep. 16, 1997

[54] METHOD OF CORRECTING THE DIMENSION OF WORKPIECES

[75] Inventors: Yasushi Nakazawa; Masayoshi Ohashi, both of Utsunomiyashi; Yasushi Tashiro, Oyamashi; Tadashi Yasuoka, Oyamashi; Akio Sugiura, Oyamashi, all of Japan

[73] Assignees: Honda Giken Kogyo Kabushiki Kaisha, Tokyo; Showa Aluminum Corporation, Osaka, both of Japan

[21] Appl. No.: 476,372

[22] Filed: Jun. 7, 1995

[30] Foreign Application Priority Data

Feb. 2, 1995 [JP] Japan ..... 7-016206

[51] Int. Cl.[6] ..... B21J 5/06

[52] U.S. Cl. ..... 72/377; 72/254; 72/701

[58] Field of Search ..... 72/254, 293, 305, 72/377, 411, 701, 702

[56] References Cited

U.S. PATENT DOCUMENTS 2,268,772 1/1942 Peterson ..... 72/377
2,357,605 9/1944 Nivison ..... 72/403
3,508,427 4/1970 Broderick ..... 72/254

FOREIGN PATENT DOCUMENTS 159229 10/1982 Japan ..... 72/377
131212 5/1993 Japan ..... 72/254

*Primary Examiner*—Lowell A. Larson
*Attorney, Agent, or Firm*—Armstrong, Westerman Hattori, McLeland & Naughton

[57] ABSTRACT

Sliced workpieces severed from a metal extrusion transversely of it and into a desired thickness, or bent ones made from the extruded metal pipes, are restrained at their regulated correct positions each in its entirety or in part. Subsequently, the workpieces are compressed in a direction to the thickness or in the direction perpendicular to the primary bending direction. Plastic deformation of or exceeding 0.5%, or more preferably 2–5%, will be produced in each workpiece. Alternatively, those sliced or bent workpieces may be pressed in a direction to that of thickness or in the direction perpendicular to a previous bending, after each workpiece is restrained in its entirety or in part at the regulated correct dimension.

7 Claims, 4 Drawing Sheets

METHOD OF CORRECTING THE DIMENSION OF WORKPIECES

BACKGROUND OF THE INVENTION

1. Field of the Invention

The present invention relates to a method of correcting the dimension of workpieces such as the brackets for mounting automobile engines, the upper arms or the like automobile parts, the parts of office automation equipments or industrial machinery.

2. Prior Art

Generally, those workpieces have been produced each by slicing metal extrusions in the direction perpendicular to extrusion and into any desired thickness, or by bending the metal extrusions into any desired curvature.

A noticeable variation has been found in the dimension of such sliced workpieces or bent workpieces. The slicing is indeed advantageous in that the workpieces of any sophisticated configuration in cross section can be produced by a simple process. However, the openings present in the sliced workpieces are likely to vary in their dimension in the order of millimeters, thus failing to qualify as precision parts. Further, the workpieces of the other type extruded and subsequently bent do suffer a considerable variation in the extent of 'spring-back', also failing to meet severe requirement of preciseness in dimension.

Thus, the dimension of workpieces produced in such a manner have had to be corrected by machining or likewise treating them, incurring much labor and spending a long time for intricate works.

OBJECTS OF THE INVENTION

An object of the present invention is therefore to provide a method of simply and accurately correcting the dimension of workpieces which are sliced pieces severed from a metal extrusion in the direction perpendicular to extrusion and into a desired thickness, or which are bent pieces made by bending the metal extrusion into a desired curvature.

Another object of the present invention is to provide a method of correcting the dimension of workpieces while conducting a secondary bending of them after sliced from a metal extrusion in the direction of its thickness, or while conducting a secondary bending of the workpieces after prepared by primarily bending the metal extrusion into a desired curvature, wherein the secondary bending is done in a pressing apparatus in a direction perpendicular to the direction of the primary bending.

Other objects as well as features and advantages of the invention will become apparent from the description made below referring to the drawings.

BRIEF DESCRIPTION OF THIS DRAWINGS

Figure 4A:
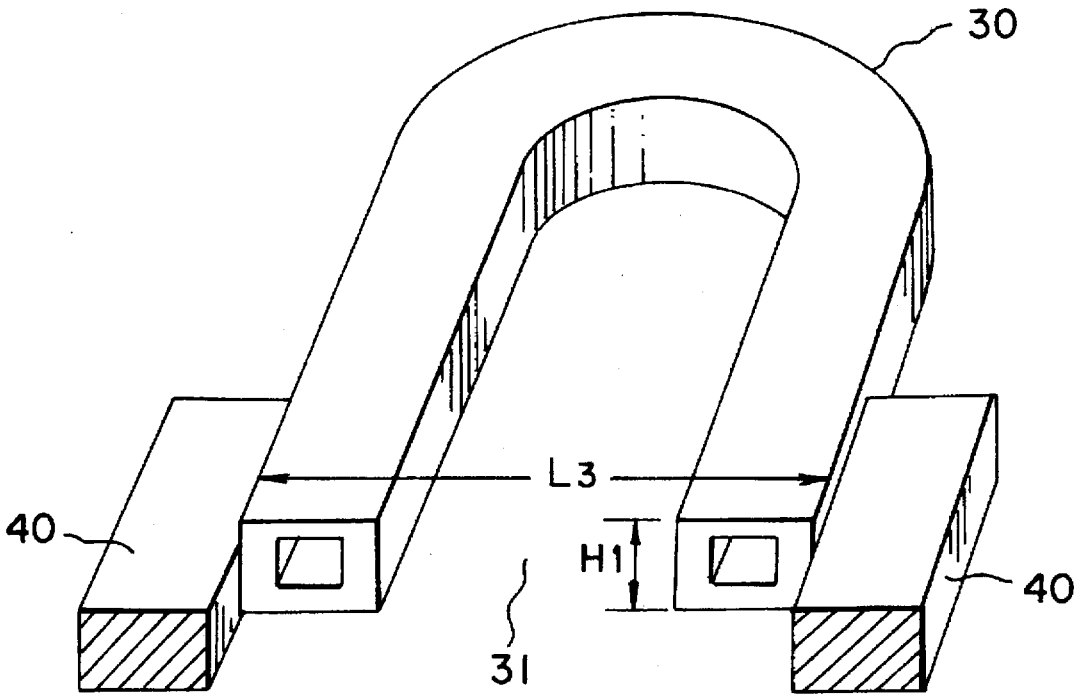
FIG. 4A is a perspective view of another workpiece hold at its accurate position so that the dimension thereof may be corrected in another embodiment of the present invention.
Figure 4B:
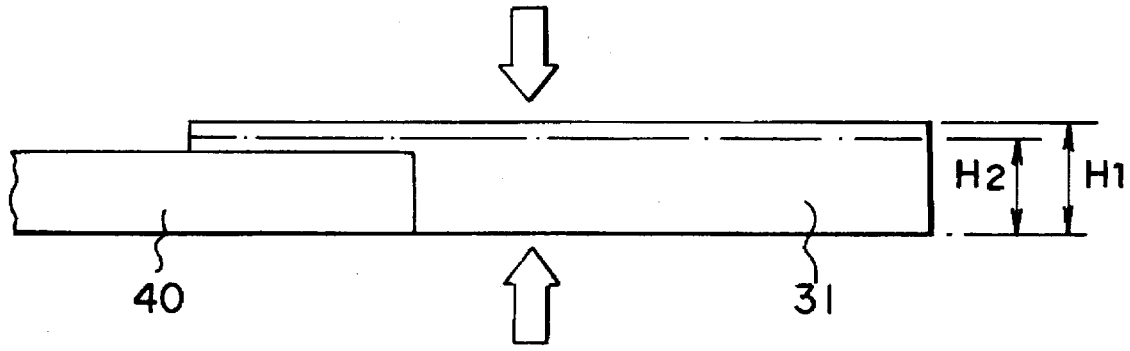

FIG. 4B As a side elevation of the workpiece shown in FIG. 4A; and

Figure 5:
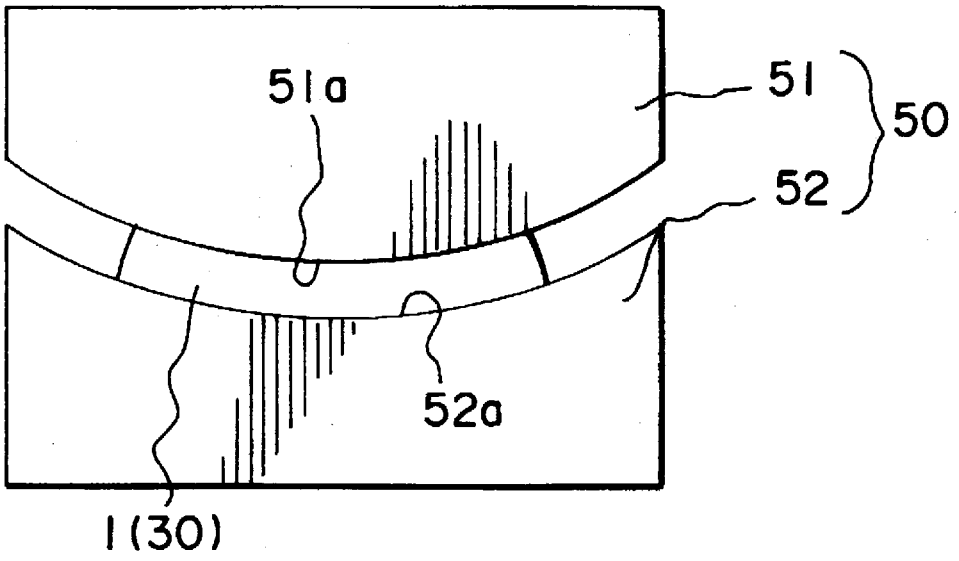

FIG. 5 is a front elevation of the workpiece shown in FIGS. 1 and 4 and being bent secondarily.

DETAILED DESCRIPTION OF THE INVENTION

In one mode of the present invention, corrected is the dimension in cross section of workpieces which have been sliced from a metal extrusion perpendicularly to the direction of extrusion and into a desired thickness.

Figure 1A:
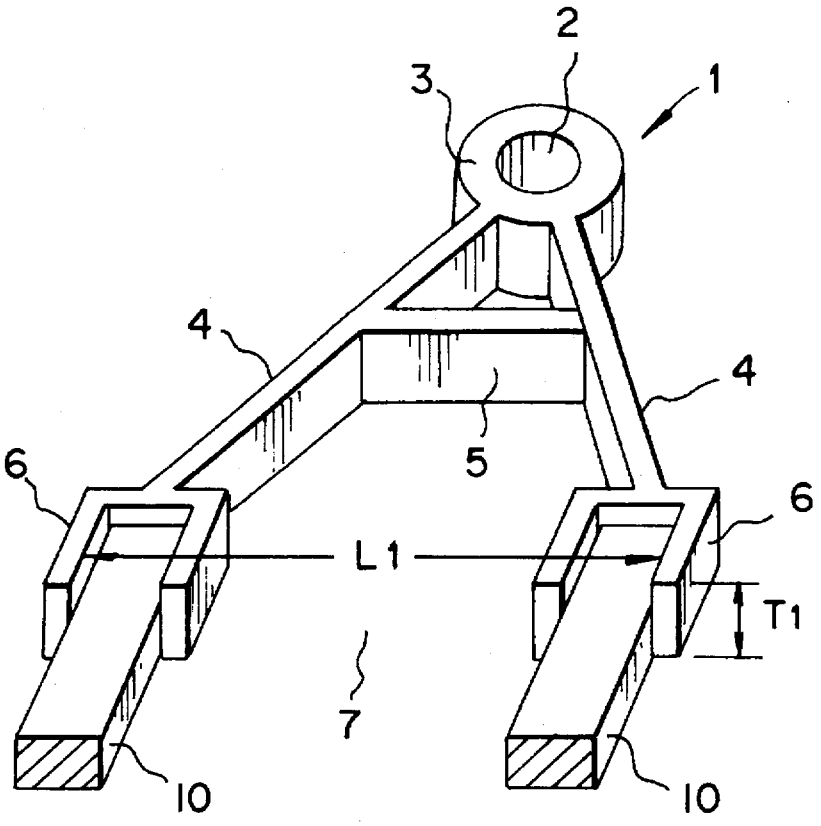
FIG. 1A is a perspective view of a workpiece hold at its accurate position so that the dimension thereof may be corrected in an embodiment of the present inventions

A noticeable variation is unavoidable in the dimension of those slices in cross section thereof (corresponding to that of metal extrusion). The dimension of any openings that may be included in the cross sections will more remarkably very among those sliced workpieces. An aluminum upper arm shown in FIG. 1A is an example of workpiece 1 made as one of automobile vehicle parts. The workpiece 1 has a ring-shaped head 3 whose central aperture 2 receives a fastener to mount this workpiece on an automobile body. A pair of bifurcate legs 4 and 4 extend radially from an outer periphery of the ring-shaped head, and are connected by a rib 5 one to another. Each arm 4 terminates as a U-shaped foot 6 having a recess opened in a direction opposite to the head 3 with respect to the rib. This workpiece as a whole will thus assume an 'A' shape, wherein the length $L_1$ of an opening 7 defined between outer upright walls of the feet 6 is particularly variable among workpieces of this type.

Figure 1B:
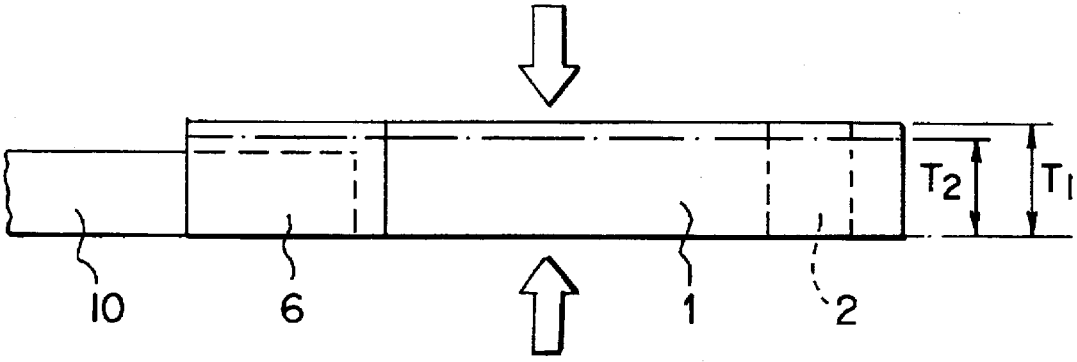
FIG. 1B is a side elevation of the workpiece shown in FIG. 1A.

Now referring to FIGS. 1A and 1B, the workpiece 1 will be forced at first into a correct and target cross-sectional shape, by using proper jigs 10. Sizes and shape of the jigs will previously be determined depending on whether an overall or any partial dimension is to be corrected. If the workpiece in this state is freed from restraint, then it will 'spring back' to its original shape and dimension.

Next, the restrained workpiece 1 will be compressed to make a plastic deformation to a certain extent. The compression will be effected in the direction of thickness of the workpiece, by means of a flat press. Such a plastic deformation will cause the restrained workpiece to slightly reduce its thickness so that it can no longer spring back to original shape and dimension, even after freed from restraint. Mechanism of this effect may be such that an intensive compression stress and strain imparted to the restrained workpiece will cause a certain plastic deformation thereof perpendicular to the direction in which it tends to elastically restore its original shape, thus almost entirely absorbing weaker components of the elastic strain previously produced in the workpiece. However, an insufficient plastic deformation $\delta$ (%), given in the term of: $(T_1-T_2)\times 100/T_1$ (wherein T1 and T2 are the thickness before compression and after compression, respectively), will render poor the effect of suppressing the springback.

Figure 2:
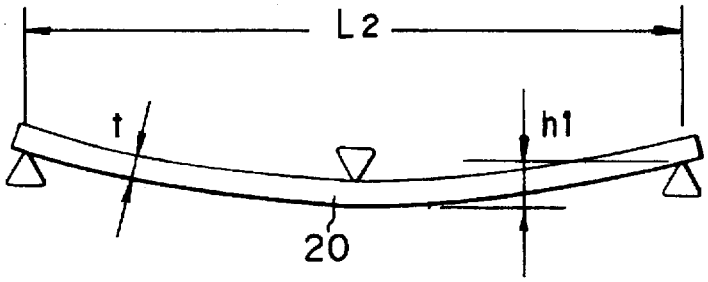
FIG. 2 is a front elevation of a test piece which is being tested for determining an optimum plastic deformation thereof.

An optimum degree of plastic deformation was investigated as follows. An aluminum alloy A6061-T4 was extruded to form a band having a width of 180 mm or more and a thickness 't' of 7 mm. Test pieces each having a thickness (or 'length' in the extrusion direction) $T_3$ of 20 mm was severed from the band, the cutting thereof being done within a plane perpendicular to the direction of extrusion. Each test piece 20 was disposed to have its major sides located up and down, and lower surfaces of two portions adjacent to the ends of the 'length' were placed on two supports spaced a distance $L_2$–180 mm from each other as shown in FIG. 2. Then, a variable load was applied to the test piece's middle portion so as to distort it to be convex downwardly a variable initial distance $h_1$ (viz. initial distortion) and to restrain the test piece 20 at this position.

Subsequently, a flat press was used to grippingly compress the restrained test piece 20 with variable force in the direction of its thickness (namely, perpendicular to the drawing paper sheet of FIG. 2). When the test piece had plastically deformed to one of predetermined extents, the load was removed from the middle portion and a remaining distortion $h_2$ of the test piece was measured.

Figure 3:
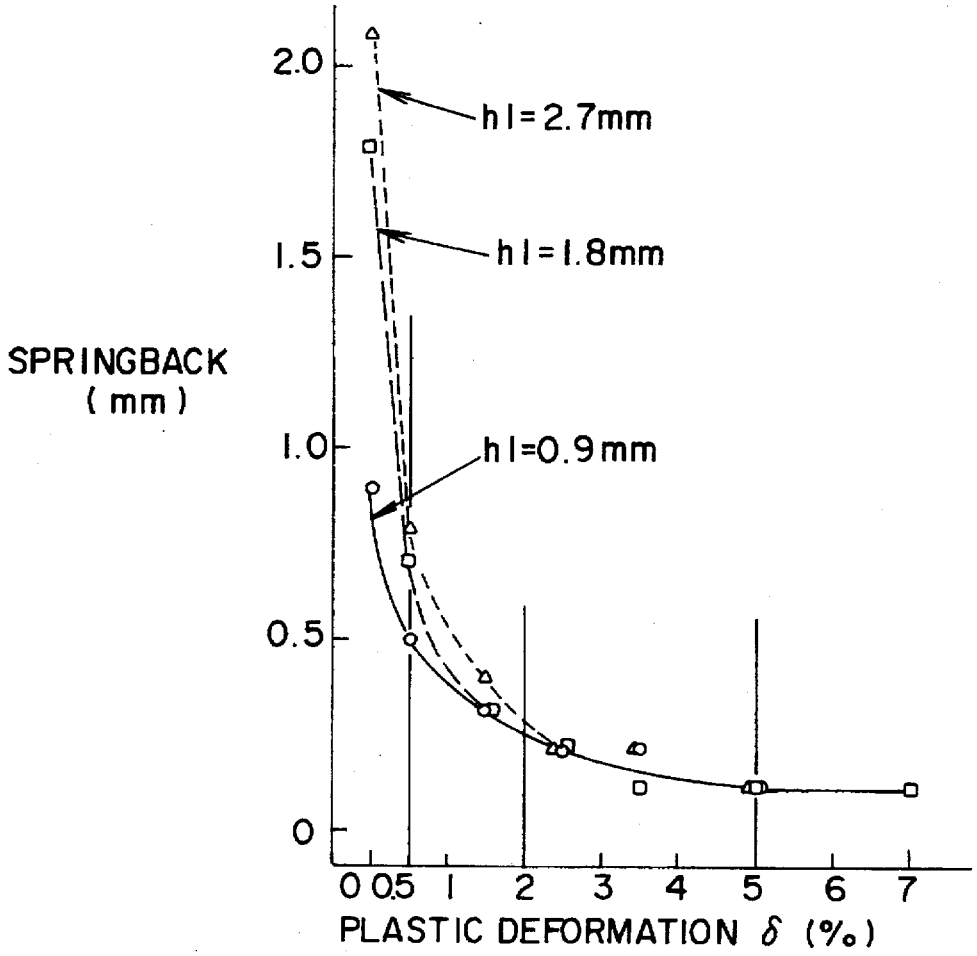
FIG. 3 is graph showing a relationship found between plastic deformation and springback of the test piece shown in FIG. 2.

By varying the compression force applied to the workpieces 20 each having the initial distortion, the springback $\Delta h$ ($=h_1-h_2$) was plotted against the plastic deformation $\delta$ (%) ($=(T_3-T_4)\times 100/T_3$, wherein $T_4$ is the thickness after compression), as shown in FIG. 3. In this investigation, the initial distortion was varied between 0.9 mm, 1.8 mm and 2.7 mm.

As seen in FIG. 3, the springback of each test piece freed from restraint decreased sharply, with the plastic deformation increasing over 0.5%. However, plastic deformation greater than 5% did not reduce the spring-back to a noticeable extent, but rather would impair the intrinsic property of workpiece. Although a greater initial distortion caused a greater springback, a plastic deformation of or greater than 2% diminished the difference in springback. Thus, a preferable extent of plastic deformation is 0.5% or more, and a more preferable range thereof is from 2–5%.

The foregoing is a description of how to correct the dimension of sliced workpieces severed from a metal extrusion in the direction perpendicular to extrusion and into a desired thickness. The same idea applies also to the workpieces of another type prepared by primarily bending the metal extrusion into a desired curvature.

A significant variation in the dimension of curvature is inherent in those bent workpieces, particularly if they have one or more openings. For example, workpieces 30 of a U-shape or reversed U-shape may be made by bending a square cylindrical extrusion, as shown in FIG. 4A. They have each an opening 31 whose length $L_3$ is not constant but vary between them.

In order to correct the dimension of those workpieces 30, they will be forced at first into an accurate and target shape, also by using proper jigs 40. Size and shape of the jigs will previously be determined depending on whether an overall or any partial dimension is to be corrected. If the workpiece 30 in this state is freed from restraint, then it will 'spring back' to its original shape and dimension.

Next, the restrained workpiece 30 will be compressed to make a plastic deformation to a certain extent. The compression will be effected in the direction perpendicular to that In which the workpiece was primarily bent, means of a flat press. Such a plastic deformation will inhibit the workpiece from springing back to its original shape, even when freed from restraint. Mechanism this effect may be such that an intensive compression stress and strain imparted to the restrained workpiece will cause a certain plastic deformation thereof perpendicular to the direction in which it tends to elastically restore its original shape, thus almost entirely absorbing weaker components of the elastic strain previously produced in the workpiece. The plastic deformation $\delta$ (%) in this case is a decrease in the height of workpiece. Thus, $\delta=(H_1-H_2)\times 100/H_1$, wherein $H_1$ is the initial height and $H_2$ is the height of the workpiece after compression, as shown in FIGS. 4A and 4B. A plastic deformation $\delta$ of or higher than 0.5% will almost sufficiently suppress the springback of each workpiece. A more desirable degree of plastic deformation $\delta$ is or higher than 2%. The plastic deformation $\delta$ should however not exceed 5%, because it will not diminish the springback any further, but rather would impair the intrinsic property of the workpiece and cause an undesirable excessive change in the dimension and/or shape thereof.

The extrusion from which the bent workpiece is obtained may either be a rigid or hollow elongate article. A hollow extrusion is preferable, because a weaker compression force will suffice for the plastic deformation.

In a further mode of the invention, the dimension of unfinished workpieces 1 will be corrected while secondarily bending it in the direction of the thickness in a pressing apparatus to provide a finished article, after sliced from a metal extrusion in the direction perpendicular to extrusion and into a desired thickness. Alternatively, the dimension of unfinished workpiece 30 will be corrected while secondarily bending it in the direction perpendicular to the direction of the primary bending in the pressing apparatus, after prepared by primarily bending the metal extrusion into a desired curvature.

The workpiece 1 or 30 will be forced at first to take a correct position and to have an accurate dimension in its cross-sectional shape or curved shape. Appropriate jigs or the like may be used to keep the unfinished workpiece in a desired right position, whether an overall or any partial dimension has to be corrected. If the workpiece 1 or 30 in this state is freed from restraint, then it will 'spring back' to its original shape and dimension.

Next, the pressing of the restrained workpiece 1 or 30 will be conducted in the direction of thickness for the sliced workpiece 1, or in the direction perpendicular to that in which the other workpiece 30 was primarily bent. The secondarily bent and finished workpiece 1 or 30 will no longer spring back, though a strong elastic stress has been exist in it until secondarily bent. Mechanism of this effect may be such that an intensive stress and strain imparted to the restrained workpiece during the secondary bending will cause a certain plastic deformation thereof perpendicular to the direction in which it tends to elastically restore its original shape, thus almost entirely absorbing weaker components of the elastic strain previously produced in the workpiece.

This effect will be obtained whether or not the workpieces 1 and 30 are secondarily pressed into the curved shape in its entirety.

In summary, sliced workpieces severed from a metal extrusion transversely thereof and into a desired thickness, or bent ones made from the extruded metal pipes, will be restrained at their positions not to spring back but to have correct dimension while they are being compressed to the thickness direction or perpendicular to the primary bending direction. Plastic deformation of 0.5% or more Which such a compression will cause prevents the springback of workpieces freed from restraint and endows them a permanently durable correct dimension. Highly accurate correction of dimension will be realized under the plastic deformation of 2–5%, without bringing about any undesirable excessive change in shape of those workpieces.

The secondary bending of those sliced or bent workpieces may be done instead of simple compression, while also restraining each workpiece in its entirety or in part at a correct dimension, so that the same effect of plastic deformation will take place to render permanent the correct dimension.

THE PREFERRED EMBODIMENTS

EXAMPLE 1

An aluminum extrusion of A6061-T4 was sawn in the direction perpendicular to extrusion, to prepare sliced workpieces 1 in the form of upper arms shown in FIG. 1A. Each workpiece had an opening 7 whose length $L_1$ was 260 mm, and had a thickness $T_1$ of 30 mm. Wall thickness of legs 4 and feet 6 was 7 mm, an outer diameter of a head 3 was 50 mm and the head 3 had a central aperture 2 having a diameter of 35 mm. The length $L_1$ of the openings 7 was found to remarkably vary among the workpieces.

A pair of jigs 10 spaced from each other a predetermined standard distance were forced into the feet 6 of each workpiece 1, which as a result deformed elastically to regulate the dimension of opening 7 accurately to 260 mm, and was restrained at this corrected position.

Next, the workpieces were subjected to a flat pressing as shown in FIG. 1B. Each workpiece was compressed at its upper and lower faces so as to reduce its thickness due to a plastic deformation.

Variation of the length $L_1$ was measured the openings 7 of those workpieces, before and after such plastic deformation. A result of this measurement is given in Table 1.

TABLE 1

| Plastic deformation (%) | Variation in length $L_1$ of openings ($\sigma_{n-1}$) (mm) | Invention/ Reference |
|---|---|---|
| 0 | 0.576 | Reference |
| 0.5 | 0.351 | Invention |
| 1.0 | 0.126 | " |
| 2.0 | 0.084 | " |
| 3.5 | 0.032 | " |
| 5.0 | 0.045 | " |
| 6.0 | 0.084 | " |

As seen in Table 1, the method proposed herein proved effective to reduce the variation in the length $L_1$ for the workpieces' openings. In detail, the plastic deformation $\delta$ of or higher than 0.5% and particularly of or higher than 2% did diminish the variation. The plastic deformation exceeding 5% did however not improve this effect any more, but rather caused an undesirable excessive change in dimension.

EXAMPLE 2

An aluminum pipe square in cross section was extruded using the alloy A6061-T4, and bent into a reversed U-shape, to prepare bent workpieces 30 shown in FIG. 4A. Each workpiece had an opening 31 defined between its legs, the length $L_3$ of the opening was 300 mm. The workpiece had a height $H_1$ of 40 mm, and wall thickness each leg was 10 mm. The length $L_3$ of the openings 31 was found to remarkably vary among the workpieces.

A pair of jigs 40 spaced from each other a predetermined standard distance were forced to fit on the outer sides of the feet of each workpiece 30, which as a result deformed elastically to regulate the dimension of opening 31 accurately to 300 mm, and was restrained at this corrected position.

Next, the workpieces were subjected to a flat pressing as shown in FIG. 4B. Each workpiece was compressed at its upper and lower faces in a direction perpendicular to that in which it was previously bent, so as to reduce its thickness due to a plastic deformation.

TABLE 2

| Plastic deformation (%) | Variation in length $L_3$ of openings ($\sigma_{n-1}$) (mm) | Invention/ Reference |
|---|---|---|
| 0 | 0.691 | Reference |
| 0.5 | 0.344 | Invention |
| 1.0 | 0.126 | " |
| 2.0 | 0.105 | " |
| 3.5 | 0.045 | " |
| 5.0 | 0.032 | " |
| 6.0 | 0.045 | " |

Variation of the length $L_3$ was measured for the openings 31 of those workpieces, before and after such plastic deformation. A result of this measurement is given in Table 2.

As seen in Table 2, the method proposed herein proved effective to reduce the variation in the length for the workpieces' openings. In detail, the plastic deformation $\delta$ of or higher than 0.5% and of or higher than 2% did diminish the variation. The plastic deformation exceeding 5% did however not improve this effect anymore, but rather caused an undesirable excessive change in dimension.

EXAMPLE 3

The same workpieces 1 as those in Example 1 were prepared to be subjected to a curved secondary pressing process. This process wan carried out using a press mold 50, which as shown in FIG. 5 comprised an upper mold 51 and a lower mold 52, both having a curved pressing surface 51*a* or 52*a*. The major sides of each workpiece 1 were gripped between those surfaces of the molds 51 and 52, and the latter were forcibly urged towards each other to compress the workpiece. During this process, said workpiece 1 was restrained in position so that the opening 7 thereof maintained the standard length $L_1$ of 260 mm. Radius of curvature 'R' was set at 24 mm in the curved pressing.

Variation in the length $L_1$ of openings 7 was measured for the workpieces 1, before and after the secondary bending or pressing summarized above. The variation $\sigma_{n-1}$ of 0.576 decreased to 0.032 due to the secondary bending.

EXAMPLE 4

The same workpieces 30 as those in Example 2 were prepared to be subjected to a curved secondary pressing process. This process was carried out using the press mold 50 as that in Example 3. The major sides of each workpiece 30 were gripped between those curved pressing surfaces 51*a* and 52*a* of the molds 51 and 52, and the latter were forcibly urged towards each other to compress the workpiece. During this process, the workpiece 30 was restrained in position so that the opening 31 thereof maintained the standard length $L_3$ of 300 mm. Radius of curvature 'R' was set at 24 mm in the curved pressing.

Variation in the length $L_3$ of openings 31 was measured for the workpieces 30, before and after the secondary bending or pressing summarized above. The variation $\sigma_{n-1}$ of 0.691 decreased to 0.032 due to the secondary bending.

It will now be apparent that the sliced workpieces of a desired thickness severed from a metal extrusion transversely thereof, or bent ones made from the extruded metal pipes, will be restrained each in entirety or in part at their positions not to spring back but to have correct dimension while they are being compressed to the thickness direction or perpendicular go the primary bending direction. Such compression will cause a plastic deformation that protects the freed workpieces from springback and endows them a permanently durable correct dimension. Therefore, the workpieces of accurate cross-sectional or curved dimension can now be produced easily and inexpensively, thus increasing the range of their use.

The forced plastic deformation will eliminate any residual stress in the workpieces quenched or otherwise hardened, thereby excluding undesirable deformation from any following processes.

Plastic deformation of 0.5% or more ensures an accurate correction of dimension, and that of 2–5% is more effective will not cause any undesirable excessive change in dimension and/or shape of those workpieces.

The secondary bending of those sliced or bent workpieces may be done instead of simple compression, while also restraining them each in entirety or in part to assure the correct dimension, so that the same effect of plastic deformation takes place to render permanent the correct dimension. Not only the workpieces of accurate cross-sectional or curved dimension are produced easily and inexpensively to increase the range of their use, but also the efficiency of secondary pressing is improved because it is done simultaneously with the correction of dimension.

What is claimed is:

1. A method of correcting a dimension of each of sliced workpieces of a desired thickness severed from a meal extrusion transversly thereof, the method comprising the step of:

restraining each workpiece at least in part at a regulated position such that the workpiece has the dimension temporarily corrected; and thereafter pressing each restrained workpiece in a direction of a thickness thereof into a bent shape, wherein said pressing step includes the step of pressing said restrained workpiece to an extent such that a springback of said restrained workpiece, when said restrained workpiece is freed from restraint, is substantially decreased.

2. The method as defined in claim 1, wherein the workpieces are made of aluminum or its alloy.

3. The method as defined in claim 1, wherein each workpiece comprises: a ring-shaped head whose central aperture receives a fastener to mount this workpiece on an automobile body; and a pair of bifurcate legs extending radially from an outer periphery of the ring-shaped head, and are connected by a rib one to another, wherein each leg terminates as a U-shaped foot having a recess opened in a direction opposite to the head with respect to the rib, so that the workpiece as a whole assumes an 'A' shape.

4. The method as defined in claim 3, wherein a distance defined between outer walls of the feet is regulated, before compressing the workpiece.

5. A method of correcting a dimension of each of bent workpieces made from a metal extrusion, the method comprising the steps of:

restraining each workpiece at least in part at a regulated position such that the workpiece has the dimension temporarily corrected; and thereafter pressing each restrained workpiece into a further bent shape in a direction perpendicular to that in which the workpiece is previously bent, wherein said pressing step includes the step of pressing said restrained workpiece to an extent such that a springback of said restrained workpiece, when said restrained workpiece is freed from restraint, is substantially decreased.

6. The method as defined in claim 5, wherein the workpieces are made of aluminum or its alloy.

7. The method as defined in claim 5, wherein the workpieces are hollow articles.

* * * * *